US006335854B1

(12) United States Patent
Stickelmaier

(10) Patent No.: US 6,335,854 B1
(45) Date of Patent: Jan. 1, 2002

(54) HIGH VOLTAGE ISOLATED RELAY DRIVER

(75) Inventor: John F. Stickelmaier, Manhattan Beach, CA (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/507,622

(22) Filed: Feb. 21, 2000

(51) Int. Cl.[7] ..... H01H 47/00
(52) U.S. Cl. ..... 361/160
(58) Field of Search ..... 361/160, 203, 361/204, 206, 182, 186

(56) References Cited

U.S. PATENT DOCUMENTS 4,951,468 A * 8/1990 Sasajima et al. ..... 361/186 X
5,914,622 A * 6/1999 Inoue ..... 327/172

* cited by examiner

*Primary Examiner*—Edward H. Tso
(74) *Attorney, Agent, or Firm*—Terje Gudmestad

(57) ABSTRACT

A method (10) and apparatus (20, 40, 50) for driving a high voltage relay wherein a command pulse (24) is divided into a series of pulses (25) before being processed by a transformer (26). The method and apparatus of the present invention allow a significantly smaller transformer to be used in the relay driver thereby effecting significant size and weight reductions on-board a satellite system.

14 Claims, 2 Drawing Sheets

HIGH VOLTAGE ISOLATED RELAY DRIVER

TECHNICAL FIELD

The present invention relates to a driver for a high voltage relay, and more particularly to a high voltage relay driver having a switching circuit and a transformer.

BACKGROUND ART

Typically, in satellite systems, a power controller is used to control the propulsion thruster system for the satellite. In general, the power controller has a power supply that requires switching of large signals.

Switching large signals is commonly achieved by relay technology. A relay driver is used to operate the relays, usually by means of a switching circuit having a transformer. In the prior art, the transformer, also known as an isolation transformer, processes an entire command pulse in one cycle. Therefore, the size of the transformer is typically 16 cubic inches, which is quite large especially for space applications.

It is a goal in most applications, and particularly space applications, to reduce the size and weight of components used on board a spacecraft. At the same time, it is critical that the operation and reliability of the application are not compromised in any way.

SUMMARY OF THE INVENTION

The present invention is a high voltage isolated relay driver that significantly reduces the size and weight of an isolation transformer. The present invention provides a method and apparatus that reduces the size of the isolation transformer by processing a command pulse in many cycles instead of one cycle. It is possible using the method and apparatus of the present invention to reduce the size and weight of the isolation transformer from the typical 16 cubic inches, to one cubic inch or less.

In the present invention, a switching circuit is provided that divides the command pulse into many smaller pulses. The smaller pulses are imposed on the isolation transformer, which in turn drives the high voltage relay. Because the transformer is processing many smaller pulses, it can be small in physical size and still provide the high voltage isolation necessary to drive the relay.

The present invention has a circuit to divide the command pulse into a series of smaller pulses. The output of the transformer is converted to a DC pulse. Each side of a relay is attached to a driver circuit, such that the relay can be driven in two directions.

It is an object of the present invention to provide high voltage isolation for a relay driver. It is another object of the present invention to significantly reduce the size and weight of a transformer component used in the relay driver.

It is a further object of the present invention to divide a command pulse into a series of smaller pulses so that the size of the transformer can be significantly reduced.

Other objects and features of the present invention will become apparent when viewed in light of the detailed description of the preferred embodiment when taken in conjunction with the attached drawings and appended claims.

BEST MODE(S) FOR CARRYING OUT THE INVENTION

The present invention is a method and apparatus for driving a high voltage relay. In the present invention, a switching circuit divides a command pulse into several smaller pulses that are imposed on a transformer, driving the relay. The output of the transformer is converted back into a DC pulse.

Figure 1:
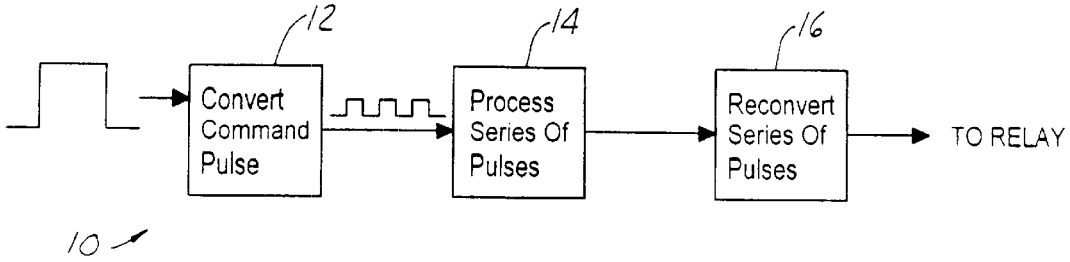
FIG. 1 is a block diagram of the method of the present invention.

FIG. 1 is a block diagram of the method 10 of the present invention. In the method 10 of the present invention, a command pulse is converted 12 into a series of smaller pulses. The series of pulses is processed 14 through a transformer. The output of the transformer is re-converted 16 into a DC pulse resembling the original command pulse.

In the prior art, a high voltage relay is driven by a circuit that is attempting to switch a 28 volt power supply to a load, with the power supply and the load floating on 1200 VDC. Typically, the drive pulse is referenced to ground. A relatively large transformer is used to change the pulse from a ground-referenced signal to a 1200 volt referenced signal, and the relay is floated on 1200 volts.

In the present invention, the command pulse is divided into a series of smaller pulses that are capable of being processed by a much smaller transformer. After processing, the output of the transformer is re-converted, or rectified, to restore the original command pulse shape. In the present invention, the output of the transformer and the high voltage relay are floated on 1200 volts.

An advantage of the present invention is that the transformer can be significantly smaller in size and weight. This is a valuable benefit, especially in space applications, where with weight save from the smaller isolation transformer can be transferred to more valuable payload consideration.

Figure 2:
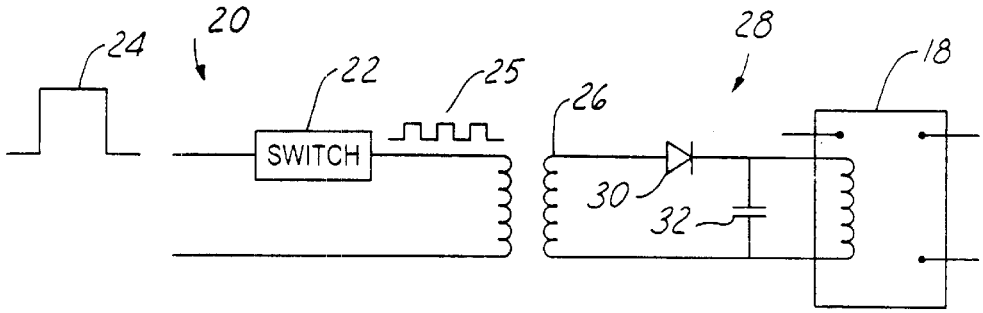
FIG. 2 is a schematic diagram of one embodiment of the present invention.

FIG. 2 is a circuit diagram of one embodiment 20 of the present invention. In the embodiment 20 shown in FIG. 2, a switching circuit 22 is used to divide the command pulse 24 into a series of smaller pulses 25.

As discussed above, the series of pulses 25 are each smaller than the command pulse 24, thereby allowing a significantly smaller transformer 26, i.e. on the order of 1 cubic inch, to be used for processing the series of pulses. A rectifier 28, following the output of the transformer 26, restores the command pulse to its original shape. In FIG. 2, the rectifier 28 is shown as a rectifying diode 30 and a capacitor 32. However, it should be noted that several other types of rectifiers exist and one of ordinary skill in the art is capable of replacing the rectifying circuit shown with any other suitable alternative. The re-converted signal drives the high voltage relay 18.

Figure 3:
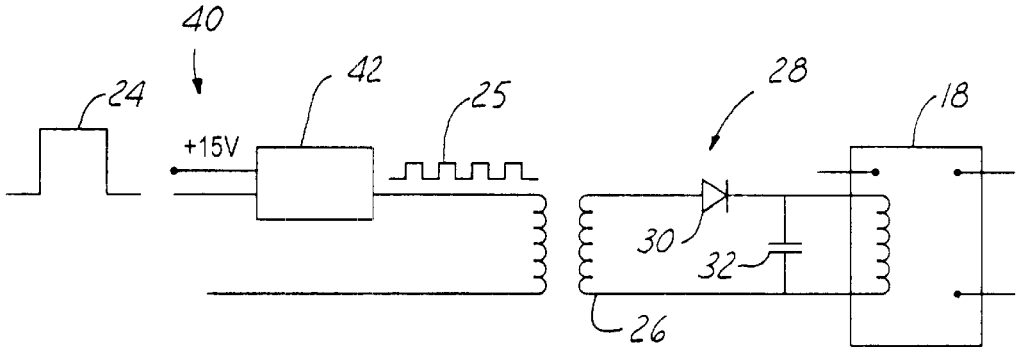
FIG. 3 is a schematic diagram of a switching circuit that can be used in conjunction with the present invention.

In FIG. 3, there is shown another embodiment 40 of the present invention in which a self-oscillator 42 is used to divide the command pulse 24 into a series of pulses 25. After the transformer 26 processes the individual pulses that make up the series of pulses 25, the rectifying circuit 28 restores the command pulse to its original shape and it is delivered to the high voltage relay 18.

Figure 4:
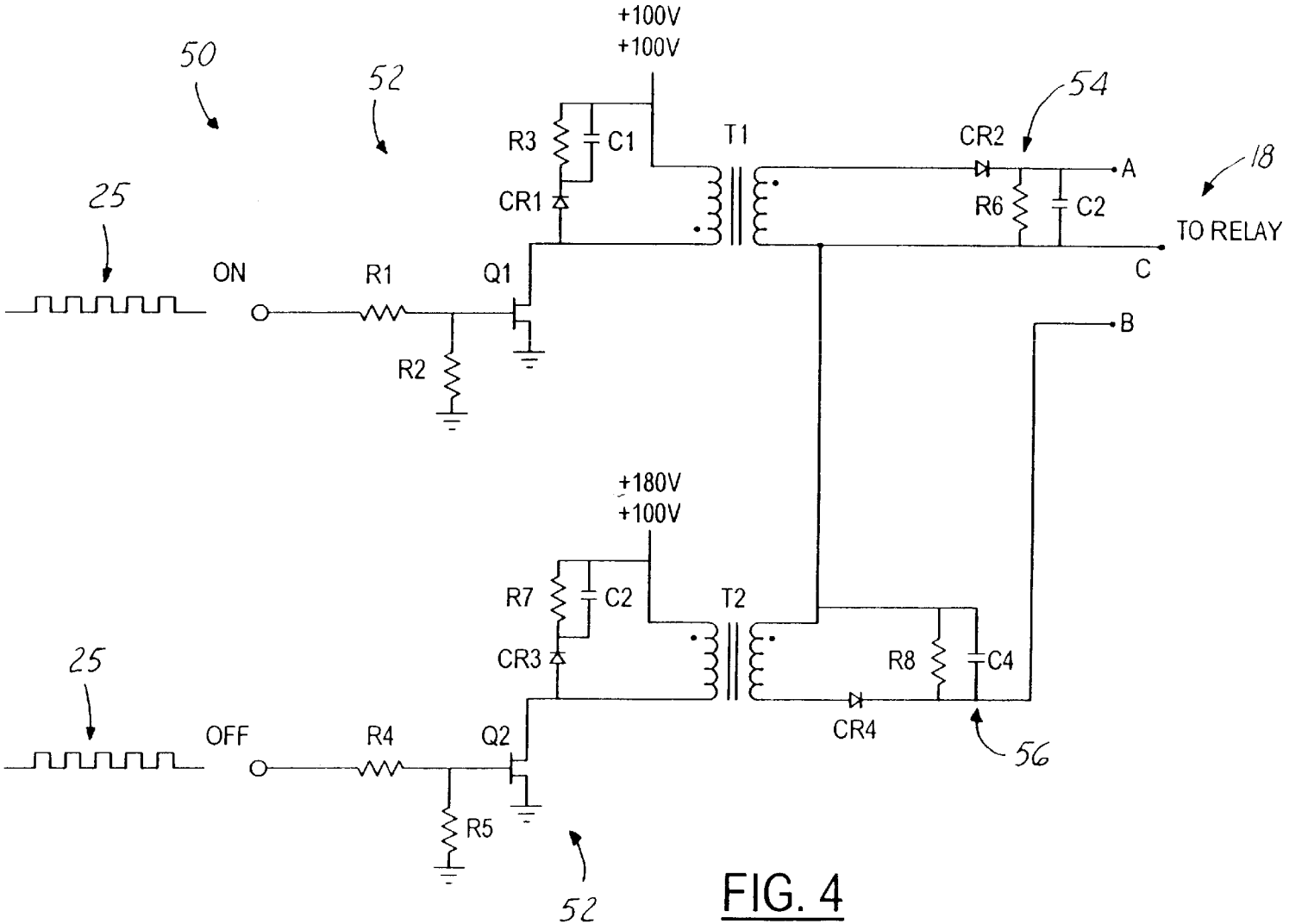
FIG. 4 is a schematic diagram of a high voltage relay having a relay driver circuit of the present invention on either side of the relay, and also showing an alternate method of providing a command pulse.

In yet another embodiment 50, shown in FIG. 4, each side, A and B, of the high voltage relay 18 is attached to a drive circuit 52 of the present invention. In this configuration, the relay 18 can be driven in two directions. Each side, A and B, of the relay 18 has its own drive circuit 52. The series of pulses 25 is switched by transistors, Q1 and Q2, through transformers, T1 and T2, in each drive circuit 52. A rectifying circuit 54, 56 in each drive circuit re-converts the series of pulses before driving the relay at each side, A and B.

Also shown in FIG. 4, is an alternate method of providing a command pulse. It is possible in the present invention, to provide a series of small pulses as the initial command pulse, and use the drive circuit of the present invention to combine the series of smaller pulses into a larger command pulse. This is shown as the series of pulses 25 at the input of the first and second drive circuits.

The series of pulses allow the size of the transformer to be significantly reduced from what is known in the prior art. For example, in the prior art, the transformer is typically 16 cubic inches. Whereas, in accordance with the method and apparatus of the present invention, the transformer is 1 cubic inch or less in size. This results in a significant size and weight reduction, which translates into significant cost savings. In space and communications applications, the size and weight reductions mean that more valuable payload applications can be substituted for the space saved by the smaller isolation transformer.

While particular embodiments of the present invention have been shown and described, numerous variations and alternate embodiments will occur to those skilled in the art. Accordingly, it is intended that the invention be limited only in terms of the appended claims.

What is claimed is:

1. A method for driving a high voltage relay with a command pulse, said method comprising the steps of:

dividing said command pulse, having a predefined shape, into a series of smaller pulses;

processing said series of pulses through a transformer;

reconverting said series of pulses output from said transformer into said predefined shape of said command pulse; and delivering said command pulse to said high voltage relay.

2. The method as claimed in claim 1 wherein said step of dividing said command pulse further comprises dividing said command pulse by a switching circuit.

3. The method as claimed in claim 1 wherein said step of dividing said command pulse further comprises dividing said command pulse by a self-oscillating circuit.

4. The method as claimed in claim 1 wherein said method is applied at either side of said high voltage relay, thereby allowing said high voltage relay to be driven in two directions.

5. A high voltage relay driver for a command pulse, said high voltage relay driver comprising:

a circuit for dividing said command pulse into a series of pulses that are smaller than said command pulse;

a transformer for processing said series of pulses;

a rectifier for reconverting said series of pulses into said command pulse and driving said high voltage relay.

6. The driver as claimed in claim 5 wherein said circuit for dividing said command pulse further comprises a switching circuit.

7. The driver as claimed in claim 5 wherein said circuit for dividing said command pulse further comprises a self-oscillating circuit.

8. The driver as claimed in claim 5 wherein a driver is connected to each side of said high voltage relay for driving said high voltage relay in two directions.

9. A high voltage relay driver for a satellite thruster power supply, said relay driver comprising:

a circuit for dividing said command pulse into a series of pulses that are smaller than said command pulse;

a transformer for processing said series of pulses;

a rectifier for reconverting said series of pulses into said command pulse and driving said high voltage relay.

10. The driver as claimed in claim 9 wherein said circuit for dividing said command pulse further comprises a switching circuit.

11. The driver as claimed in claim 9 wherein said circuit for dividing said command pulse further comprises a self-oscillating circuit.

12. The driver as claimed in claim 9 wherein a driver is connected to each side of said high voltage relay for driving said high voltage relay in two directions.

13. A method for driving a high voltage relay with a command pulse, said method comprising the steps of:

processing a series of pulses through a transformer;

combining said series of pulses output from said transformer into said command pulse; and delivering said command pulse to said high voltage relay.

14. The method as claimed in claim 13 wherein said method is applied at either side of said high voltage relay, thereby allowing said high voltage relay to be driven in two directions.

* * * * *